US011279385B2

(12) United States Patent
Bjurström

(10) Patent No.: US 11,279,385 B2
(45) Date of Patent: Mar. 22, 2022

(54) TRAIN COMMUNICATION SYSTEMS WITH SHIELDED ANTENNAS

(71) Applicant: ICOMERA AB, Gothenburg (SE)

(72) Inventor: Joel Bjurström, Gothenburg (SE)

(73) Assignee: Icomera AB, Gothenburg (SE)

( * ) Notice: Subject to any disclaimer, the term of this patent is extended or adjusted under 35 U.S.C. 154(b) by 0 days.

(21) Appl. No.: 16/834,292

(22) Filed: Mar. 30, 2020

(65) Prior Publication Data

US 2020/0317236 A1 Oct. 8, 2020

(30) Foreign Application Priority Data

Apr. 4, 2019 (SE) ..... 1950420-8

(51) Int. Cl.

| | |
|---|---|
| ***B61L 15/00*** | (2006.01) |
| ***H01Q 1/32*** | (2006.01) |
| ***H01Q 1/42*** | (2006.01) |
| ***H01Q 13/06*** | (2006.01) |

(52) U.S. Cl.

CPC ..... *B61L 15/0027* (2013.01); *H01Q 1/32* (2013.01); *H01Q 1/325* (2013.01); *H01Q 1/3275* (2013.01); *H01Q 1/3291* (2013.01); *H01Q 1/421* (2013.01); *H01Q 13/06* (2013.01)

(58) Field of Classification Search

CPC .. B61L 15/0027; H01Q 1/3275; H01Q 1/421; H01Q 13/06; H01Q 1/42; H01Q 1/526; H01Q 21/064; H01Q 1/3283

See application file for complete search history.

(56) References Cited

U.S. PATENT DOCUMENTS

| | | | | |
|---|---|---|---|---|
| 6,768,471 | B2 | 7/2004 | Bostwick et al. | |
| 6,933,900 | B2 | 8/2005 | Kitamori et al. | |
| 8,508,421 | B2 * | 8/2013 | Mishan | H01Q 9/0457 343/771 |
| 9,199,653 | B2 * | 12/2015 | Smith | H04W 28/085 |

(Continued)

FOREIGN PATENT DOCUMENTS

| | | |
|---|---|---|
| EP | 2603053 | 6/2013 |
| EP | 3021418 A1 | 5/2016 |
| EP | 3089265 | 11/2016 |

OTHER PUBLICATIONS

European Extended Search Report dated Jul. 31, 2020 received in related European Patent Application No. 20164442.4.

(Continued)

*Primary Examiner* — Vibol Tan

(74) *Attorney, Agent, or Firm* — Avant Law Group, LLC

(57) ABSTRACT

Wireless communication systems for a vehicle, such as a train, are disclosed. In an embodiment, the wireless communication system includes a communication unit, an antenna, a power cable, a data transferring path, and a protective shield. The communication unit is arranged inside the vehicle. The antenna is provided on or above an exterior metal surface, such as the roof, of the vehicle. The power cable and the data transferring path connect the antenna and the communication unit. The protective shield is made of a conductive material, and is electrically and mechanically bonded to the exterior metal surface of the vehicle. The protective shield includes a cavity for accommodating the antenna, and at least one waveguide aperture extends through the protective shield and into the cavity.

13 Claims, 4 Drawing Sheets

(56) References Cited

U.S. PATENT DOCUMENTS

| | | | | |
|---|---|---|---|---|
| 10,027,014 | B2 * | 7/2018 | Kim | H01Q 21/24 |
| 10,555,027 | B2 * | 2/2020 | Karlsson | H04H 20/62 |
| 2012/0306710 | A1 | 12/2012 | Mishan et al. | |
| 2016/0268790 | A1 | 9/2016 | Panfil et al. | |
| 2017/0047649 | A1 | 2/2017 | Himmelstoss | |
| 2017/0078729 | A1 * | 3/2017 | Karlsson | H04L 67/12 |
| 2017/0187100 | A1 * | 6/2017 | Fotheringham | H01Q 1/405 |
| 2018/0048060 | A1 * | 2/2018 | Be | H01Q 1/48 |
| 2019/0013590 | A1 | 1/2019 | Rowell | |
| 2019/0089041 | A1 * | 3/2019 | Lee | H01Q 1/48 |

OTHER PUBLICATIONS

Swedish Application No. 1950420.8, Search Report dated Oct. 29, 2019, 31 pages.

Office action, dated Jul. 19, 2021, 9 pages, issued in European Application 20164442.4.

* cited by examiner

TRAIN COMMUNICATION SYSTEMS WITH SHIELDED ANTENNAS

CROSS REFERENCE TO RELATED APPLICATIONS

This application claims priority to Swedish application number 1950420-8, filed on Apr 4, 2019, the disclosure of which is incorporated by reference herein in its entirety.

FIELD OF THE DISCLOSURE

The disclosure relates generally to wireless communication systems of vehicles. More specifically, the disclosure relates to wireless communication systems including one or more antennas mounted on trains running near high-voltage lines.

BACKGROUND

In order to ensure safety of a train carriage, all equipment mounted on the roof of a train with connections to the inside of the carriage must be protected from the high voltage power lines above the train track (in Sweden 16 kV), so that the inside of the carriage is protected if a power line falls down on the train.

However, as wireless communication increases and becomes more sophisticated and advanced, there is a growing need to provide communication equipment, and in particular antennas, on external surfaces of vehicles. There is an increasing need for high-performance and highly reliable digital communications to and from trains. Traditionally, digital communications for onboard Internet access, payment terminals, passenger information, entertainment, et cetera has been furnished through commercially available cellular networks and/or satellite links.

The availability of large portions of radio spectrum in the millimeter wave bands has been recognized by cellular network research and standardization bodies, notably exemplified by the use of such bands in upcoming 5G networks. Similar efforts are underlying local-area wireless network standardization bodies, as exemplified by the 60 GHz 802.11 ad standards.

Antennas mounted on the outside of a train must have certain properties related to electrical safety. A widely cited codification of such requirements is UIC 533 section 7, which requires the electrically conducting parts of an antenna to be grounded to the steel body of the train. Such requirements prevent hazardous high voltages from entering the train through the antenna cabling, in the event of a catenary (overhead high-voltage line) falling on the train, striking the antenna, and shorting such voltage directly to ground through the steel body of the train.

Similar requirements are posed by company technical standards within large train operators (e.g., Deutsche Bahn), as well as in other industry-wide standards (e.g., EN 50153). A common quantitative requirement is that an antenna must be able to withstand a 40-kA electrical current to ground for a duration of 0.1 second. Accordingly, the required dimensions for the shorting connection are approximately 95 mm for copper, which is the minimum dimension to make sure the shorting protection for the power supply unit reacts in time.

Such requirements are easily fulfilled in lower frequency (microwave, VHF, et cetera) passive antennas, which may readily be designed as DC shorted structures.

More problematic is the satellite antenna, which is typically a mechanically steered tracking antenna requiring many electronic components within the antenna structure. Thus, the antenna structure as a whole cannot be short-circuited to ground, and there is a need to supply power to the electronic components. For this situation, the regulations permit an alternate, equivalent-safety solution; namely high-pass filtering of all cabling that enters into the train, with the high-pass filters having a high dielectric strength, combined with a surge arrestor. Such arrangement prevents any DC voltage or high-voltage spike from entering the train, but adds significant cost and complexity to the antenna system.

Another solution is to provide a galvanic separation between the parts arranged externally on the train and the parts arranged internally. Such a system was disclosed in EP 1 416 583, by the same applicant. However, this solution may also be relatively costly and complex.

For high frequency antennas, in particular millimeter wave antennas, the problems get even more pronounced.

Commercial millimeter wave antennas are active antennas with integrated electronics, which face similar challenges to the satellite antennas regarding high-voltage protection, and also need a continuous supply of power during operation.

These problems are not only related to trains, but also other types of vehicles requiring antennas to be mounted on external surfaces of the vehicle, and in particular for vehicles operated in the vicinity of high voltage, such as electric trams, buses, vans, cars, et cetera.

There is therefore a need for an improved wireless communication system providing adequate protection in a simpler and more cost-effective way.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

In some embodiments, a wireless communication system for a vehicle includes a communication unit arranged inside the vehicle, an antenna provided on or above an exterior metal surface of the vehicle, a power cable connecting the antenna to the communication unit, a data transferring path connecting the antenna to the communication unit, and a protective shield made of a conductive material. The protective shield is electrically and mechanically bonded to the exterior metal surface of the vehicle and includes a cavity for accommodating the antenna. A waveguide aperture extends through the protective shield and into the cavity. The waveguide aperture enables radio frequency waves to pass through the protective shield into and out from the antenna.

Optionally, the antenna operates at a frequency larger than 1 GHz.

Optionally, the antenna is an active antenna.

Optionally, the antenna includes an array of antenna elements. Each antenna element is connected to a separate transceiver.

Optionally, the protective shield includes a plurality of waveguide apertures. Each antenna element is provided with an individual waveguide aperture.

Optionally, the protective shield is made of a solid metal material.

Optionally, an exterior wall of the protective shield has a thickness larger than 1 cm. The waveguide aperture has a thickness larger than 1 cm.

Optionally, the protective shield includes a base area, a top area, and side walls. The base area is in contact with the exterior metal surface of the vehicle. The top area is opposite to the base area. The base area has a longer width or a longer length than the top area. The side walls extend between the base area and the top area. At least one of the side walls is arranged in a slanted disposition.

Optionally, the waveguide aperture has a rectangular or circular cross-section.

Optionally, the waveguide aperture has a cross-sectional dimension less than 10 mm.

Optionally, the protective shield includes a plurality of waveguide apertures. The plurality of waveguide apertures extend in parallel with each other.

Optionally, the plurality of waveguide apertures is provided in a plane in parallel with the exterior metal surface. The plurality of waveguide apertures form a row of waveguide apertures.

Optionally, the plurality of waveguide apertures are provided in two or more planes in parallel with the exterior metal surface. The plurality of waveguide apertures form rows and columns of waveguide apertures.

Optionally, the communication unit includes at least one router in the vehicle. The router is configured to receive and transmit wireless data packets from and to a stationary communication server outside the vehicle through at least one exterior mobile network via the antenna. And the router is configured to receive and transmit wireless data packets from and to at least one client onboard the vehicle via at least one access point connected to the router.

Optionally, the wireless communication operates in compliance with Wireless Local Area Network (WLAN) standards.

Optionally, the wireless communication operates in compliance with cellular network standards.

BRIEF DESCRIPTION OF THE DRAWINGS

Illustrative embodiments of the present disclosure are described in detail below with reference to the figures.

DETAILED DESCRIPTION

The following describes some non-limiting embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure. The embodiments described in the following are related to trains. However, a person of ordinary skill in the art would understand that the methods and systems may be correspondingly useable on other rail-bound vehicles, other electrical vehicles, and other vehicles in general.

Figure 1:
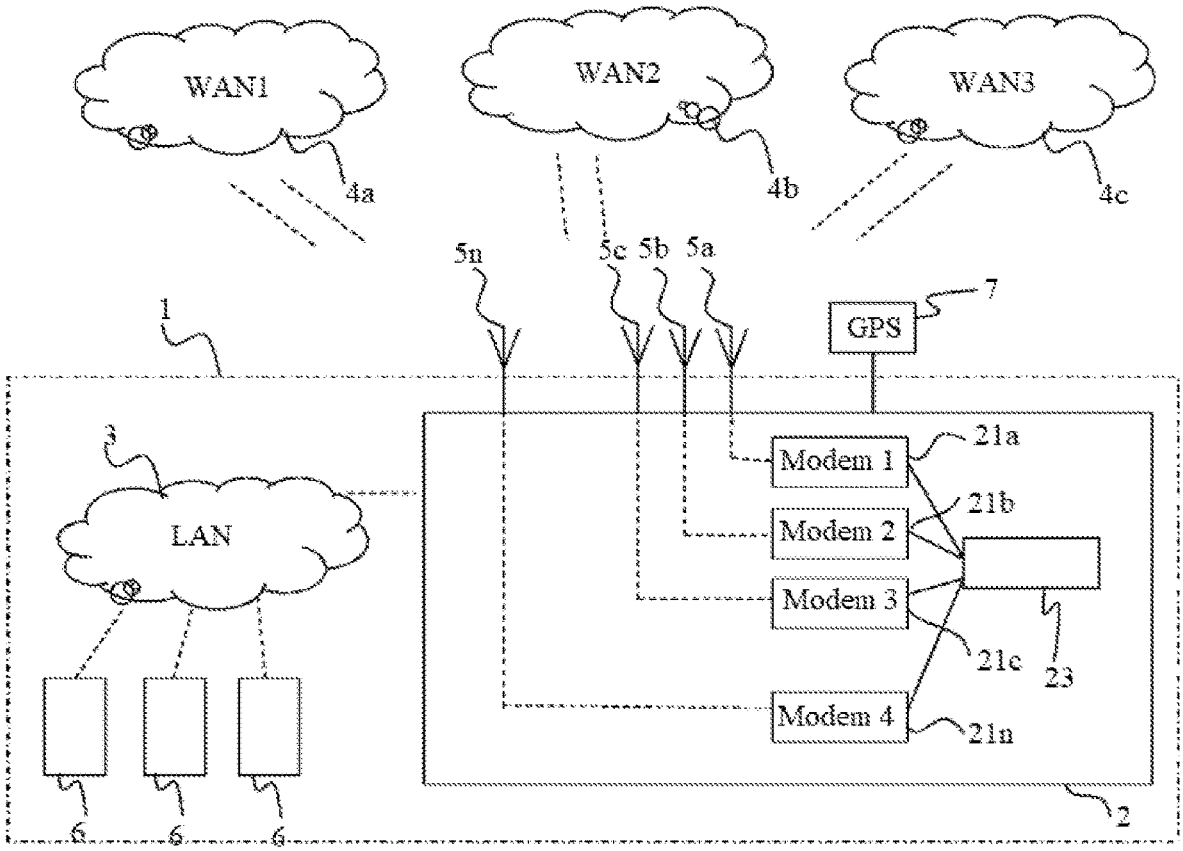
FIG. 1 is a schematic illustration of a train having a wireless communication system according to an embodiment of the disclosure.

FIG. 1 is a schematic illustration of a train 1 having a wireless communication system according to an embodiment of the disclosure. Here, the communication system may include a data communication router 2 for receiving and transmitting data between an internal local area network (LAN) 3, and one or several external wide area networks (WANs) 4*a*, 4*b*, 4*c*. The data communication router 2 may include at least one external network having a plurality of trackside base stations/access points distributed along a vehicle path of travel, optionally for communication in compliance with Wireless Local Area Network (WLAN) standards such as 802.11 standards.

Communication to and from the WANs 4*a*-4*c* may be provided through one or more of antennas 5*a*-5*n* arranged on the train 1. The antennas 5*a*-5*n* may be arranged on the roof of the train 1, on side walls of the train 1, et cetera. Two or more data links may be available, either between the train 1 and one of the WANs 4*a*-4*c*, and/or by using several WANs 4*a*-4*c* simultaneously.

The LAN 3 may be a wireless network using one or more internal antennas to communicate with terminal units 6 within the vehicle 1. It may also be possible to use a wired network within the vehicle 1. The LAN 3 may be implemented as wireless access point(s). The client(s) 6 may be computing devices such as laptops, mobiles telephones, PDAs, tablets, et cetera.

The data communication router 2 may further include a plurality of modems 21 a-n. Assignment of data streams to different WANs 4*a*-4*c* and/or to different data links on one WAN may be controlled by a router controller 23. The router controller 23 may be implemented as a software controlled processor. However, the router controller 23 may alternatively be implemented wholly or partially in hardware.

The system may include a receiver for receiving GNSS (Global Navigation Satellite System) signals, such as a global positioning system (GPS) receiver 7 for receiving GPS signals, indicative of the current position of the vehicle. The GNSS/GPS signals may be used for providing positioning data for applications which are less critical, and where the requirements for accuracy and security are low. It may also be used as a complement to position determination based on radio signal measurement to improve the accuracy and robustness even further.

The data communication router 2 may be denominated Mobile Access Router (MAR) or Mobile Access and Applications Router (MAAR).

Figure 2:
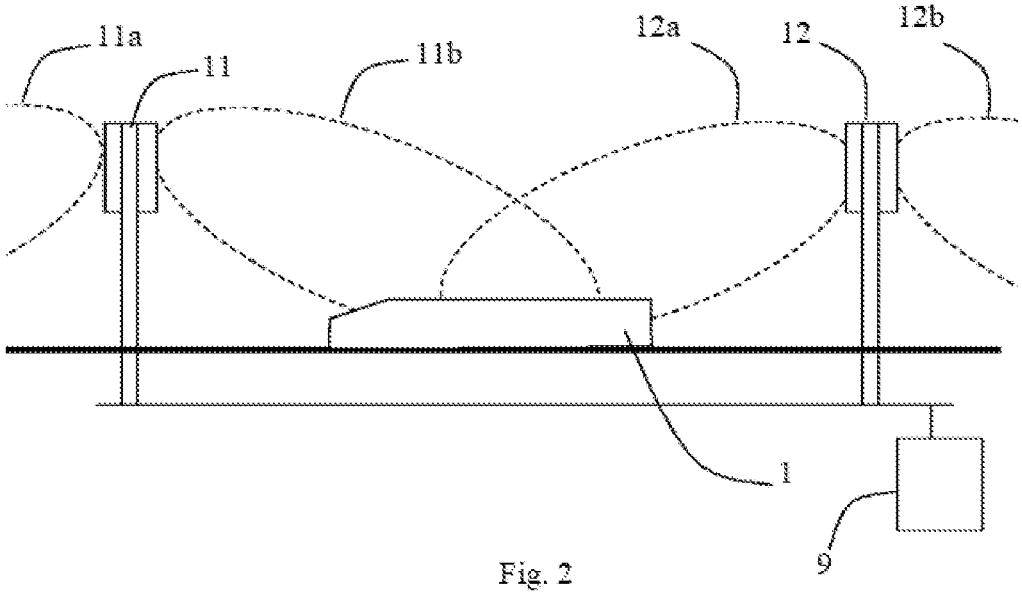
FIG. 2 is a schematic illustration of a train associated with two trackside base stations of an external mobile network according to an embodiment of the disclosure.

FIG. 2 is a schematic illustration of the train 1 associated with two trackside base stations of an external mobile network according to an embodiment of the disclosure. Here, the external wide area network (WAN) may include a plurality of trackside base stations (e.g., trackside access points) distributed along a vehicle path of travel (e.g., the rail) for communication in compliance with Wireless Local Area Network (WLAN) standards such as 802.11 standards. The external mobile network may include a plurality of trackside base stations 11, 12 arranged along the vehicle path. The antenna devices may have coverage areas 11*a*, 11*b*, 12*a*, 12*b* extending in both directions along the vehicle path. The coverage areas on the two sides of the antenna devices may be related to the same base station/access point, or to different base stations/access points. As a result, coverage areas 11*a* and 11*b* may be related to the same base station/access point, or be operated independently, as different base stations/access points. Similar configurations may apply to coverage areas 12*a* and 12*b,* et cetera.

The base stations/access points may be connected to a controller 9 via a wired or wireless connection (e.g., a fiber connection). The controller 9 may be implemented on a processor, and at least partially in software. However, the controller 9 may also be implemented on several processors, in a distributed fashion. The coverage areas may be overlapping, enabling the mobile router of the vehicle 1 to access several access points simultaneously and to distribute the communication between several data links.

The mobile router may also be connected to other external networks, and may consequently simultaneously distribute the communication also over these networks.

Figure 3:
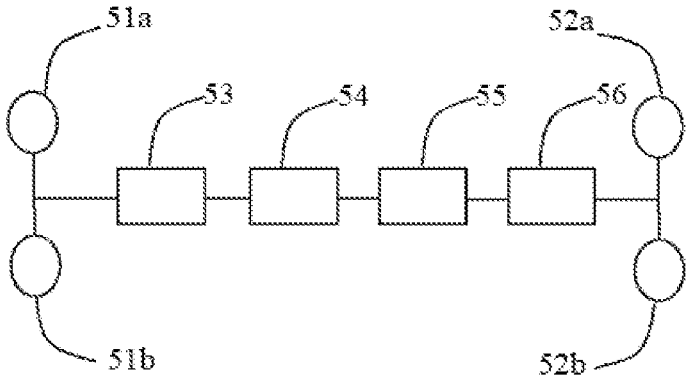
FIG. 3 is a schematic illustration of an antenna configuration used on the trains of FIGS. 1 and 2.

The vehicle 1 may include a plurality of antennas for communicating with different links and different external networks. A schematic illustration of such an antenna configuration is provided in FIG. 3. The plurality of antennas may be arranged on the roof of the train 1, and may include directional antennas 51*a* and 51*b* directed to access points in the backward direction of the train 1, directional antennas 52*a* and 52*b* directed to access points in the forward direction of the train 1, and additional antennas 53-56 arranged to communicate with base stations of other external networks (e.g., via GSM, Satellite, DVB-T, HSPA, EDGE, 1X RTT, EVDO, LTE, Wi-Fi, WLAN, and WiMAX). However, one or more antennas may also be arranged at the front side and/or the rear side of the train 1.

One or more of the antennas may be shielded antennas, and embodiments of shielded antenna arrangements 8 are discussed with reference to FIGS. 4-6. An antenna 81 may be provided on or above an exterior metal surface 82 of the vehicle 1, such as on the roof. However, the antennas may in addition, or instead, be arranged on side walls or other places of the vehicle 1.

The antenna 81 may be an active millimeter-wave antenna such as an active phased array antenna for high frequencies. The operating frequency may be 1 GHz or higher. The operating frequency of the antenna may be within the extremely high frequency (EHF) range extending between 30 and 300 GHz, which corresponds to a wavelength of 1-10 mm. The antenna may include an array of antenna elements, with each antenna element being connected to a separate transceiver. In FIG. 4, the transceiver and antenna element array is labeled 181. The transceivers may be powered by the power cable.

The electronics of the antenna 81, such as transceiver(s), may be powered by a power cable 83 connecting the antenna 81 to a communication unit arranged inside the vehicle 1, such as the router 2. The same cable 83, or a separate/different cable, may also be used as a data transferring path connecting the antenna to the communication unit.

A protective shield 84 may be arranged on top of the antenna 81. The shield 84 may be formed of a conductive material such as aluminum, and may be electrically and mechanically bonded to the exterior metal surface 82 of the vehicle 1 by bolts 85 or other suitable fasteners.

The shield 84 may be made as a solid piece of metal, and may include a cavity 86 for accommodating the antenna 81. The cavity 86 may have an opening facing the external metal surface 82 for accommodating the power and data cable 83.

The antenna 81 may be connected to an interior wall of the cavity 86, but may alternatively be connected to the exterior metal surface 82 of the vehicle 1.

The shield 84 may further include at least one waveguide aperture 87 extending through the protective shield 84 and into the cavity 86. The waveguide apertures 87 may transfer radio frequency waves through the protective shield 84 into and out from the antenna 81.

Optionally, the protective shield 84 may include a plurality of waveguide apertures 87, and each antenna element may be provided with a waveguide aperture 87.

Figure 4:
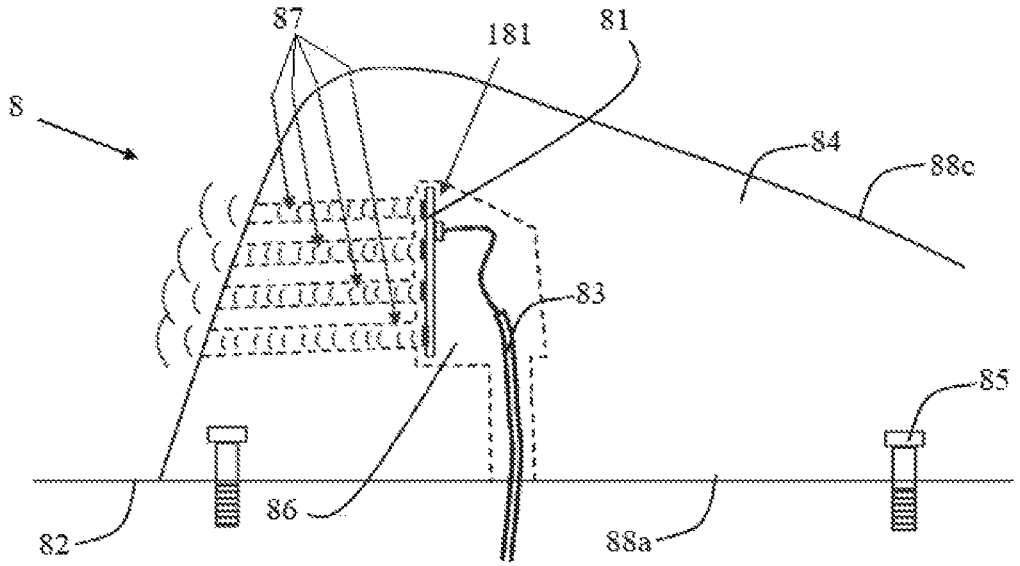
FIG. 4 is a partial sectional schematic side view of an antenna structure connected to a train roof according to an embodiment of the disclosure.
Figure 5:
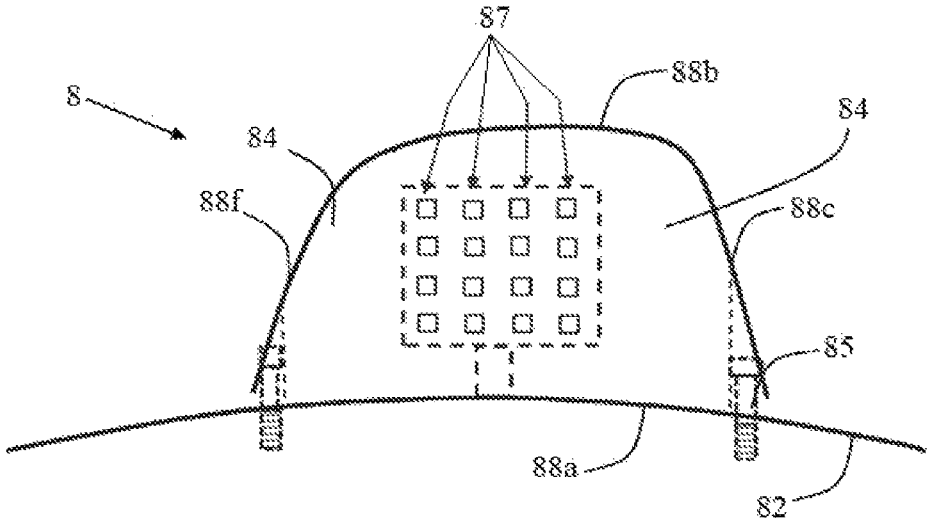
FIG. 5 is a partial sectional schematic frontal view of the antenna structure of FIG. 4.
Figure 6:
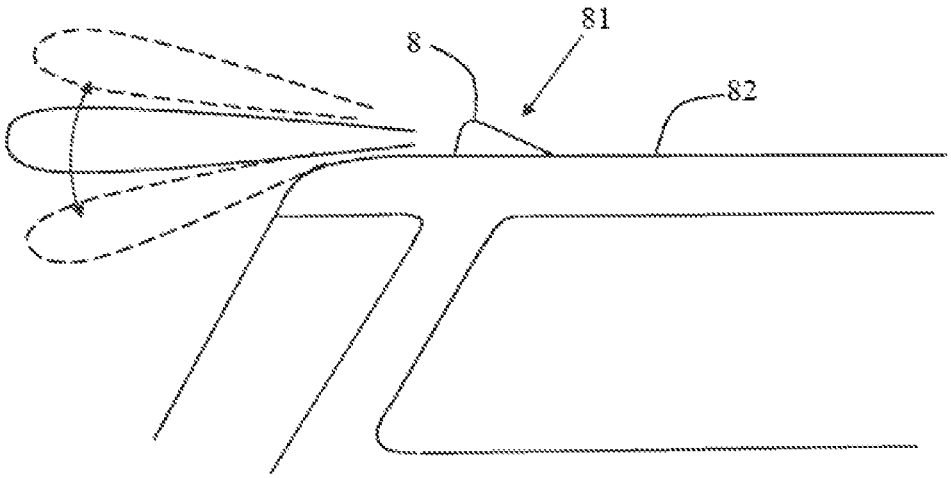
FIG. 6 is a schematic side view of the antenna structure of FIG. 4.

The waveguide aperture(s) 87 may have a rectangular cross-section, as shown in the illustrative example of FIGS. 4-6. However, other cross-sectional shapes (e.g., circular cross-section) may also be used. The maximum cross-sectional dimension may be less than 10 mm, and preferably less than 5 mm. At the present radio frequencies, the holes may be a few millimeters along their largest cross-sectional dimension. For instance, an antenna for the 60 GHz millimeter-wave band could use a WR15-section waveguide with a cross-section of 3.76×1.88 mm.

If multiple waveguide apertures 87 are used, they may be arranged side-by-side in a horizontal pattern and be backed by a corresponding plurality of radiating elements of the antenna within the cavity 86. The plurality of waveguides 87 may also be arranged in a grid as shown in FIGS. 4-6 such that beamforming may be performed in both the horizontal and vertical planes.

Optionally, the waveguide apertures 87 extend in parallel with each other. In particular, a plurality of waveguide apertures 87 may be provided in one or several planes being essentially parallel to the exterior metal surface 82.

The shield 84 may be formed by a solid metal material (e.g., aluminum). According to an embodiment, the shield 84 may have a minimum exterior wall thickness and a minimum waveguide aperture length both exceeding 1 cm, preferably exceeding 1.5 cm, and more preferably exceeding 2 cm.

The active electronic circuitry of the antenna 81 may be placed in the cavity 86 inside the structure of the protective shield 84. The cavity 86 may occupy less than 50% of the total volume of the protective shield 84, preferably less than 45%, and more preferably less than 40%.

The shield 84 may have an outwardly rounded configuration with a convex shape extending away from the exterior metal surface 82. Specifically, the shield 84 may have a base area 88*a* provided to be in contact with the exterior metal surface of the vehicle and a top area 88*b* opposite to the base area 88*a*. The base area 88*a* may have a larger extension in at least a width or length direction than the top area 88*b*. Side walls 88*c-f* may extend between the base area 88*a* and the top area 88*b*. At least one of the side walls 88*c-f* may be arranged in a slanted disposition. According to an embodiment, several (or all) of the side walls 88*c-f* may be arranged in a slanted disposition. The slanted disposition and the enlarged base area may provide a more robust and more securely fixated shield, which may increase the safety and mechanical security. In particular, the slanted side wall(s) may minimize the effects of physical impacts such as hits by falling cables and the like, and steer away any hitting object.

The angle of the slanted side wall(s) may be in the range of 10-80 degrees in relation to the exterior metal surface 82, preferably in the range of 20-70 degrees, and more preferably in the range of 30-60 degrees.

The side wall 88*c* facing the travelling direction of the vehicle may be more slanted than the other side walls, such as being in the range of 10-60 degrees, preferably in the range of 20-50 degrees, and more preferably in the range of 20-40 degrees.

The side walls 88*d-f* not facing in the travelling direction of the vehicle may be slightly less slanted, such as being in the range of 30-80 degrees, preferably in the range of 30-70 degrees, and more preferably in the range of 40-60 degrees.

Figure 7:
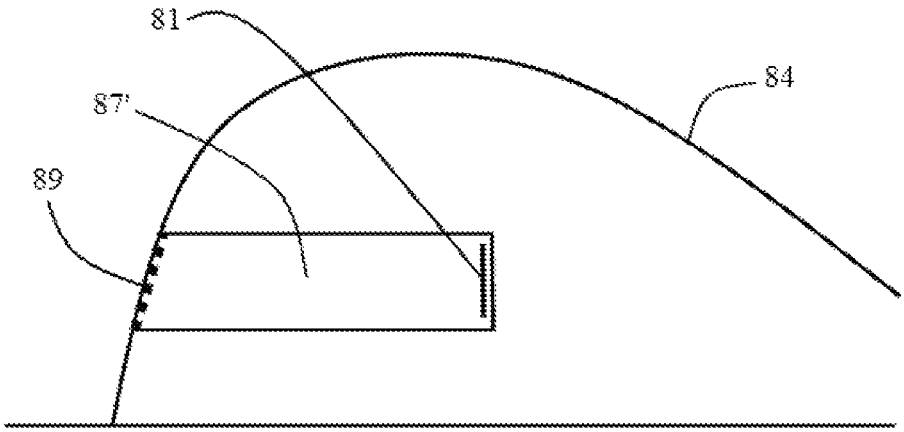
FIG. 7 is a partial sectional schematic side view of an antenna structure connected to a train roof according to an embodiment of the disclosure.

In an alternative embodiment of the protective shield 84 as illustrated in FIG. 7, a larger waveguide aperture 87' may be used. Here, a single waveguide aperture 87' is implemented, through which the wave signals to and from all the antenna elements of the antenna 81 propagates. However, alternatively, more than one waveguide aperture, but fewer than the number of antenna elements, may be used. For example, two, three, or more waveguide apertures may be used. According to an embodiment, the outlet opening of the waveguide aperture 87' may be further covered by a protective cover 89 to prevent dirt and the like from entering the waveguide aperture 87'.

The above-described embodiments of the disclosure may be implemented in any of numerous ways. For example, the embodiments may be implemented using hardware, software, or a combination thereof. When implemented in software, the software code may be executed on any suitable processor or collection of processors, whether provided in a single computer or distributed among multiple computers.

Also, the various methods or processes outlined herein may be coded as software that is executable on one or more processors that employ any one of a variety of operating systems or platforms. Additionally, such software may be written using any of a number of suitable programming languages and/or conventional programming or scripting tools, and also may be compiled as executable machine language code.

Such and other obvious modifications must be considered to be within the scope of the disclosure, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements.

Various embodiments of the disclosure may have one or more of the following effects.

In some embodiments, the disclosure provides a wireless communication system for vehicles, and in particular rail-bound vehicles, such as trains, which may help to alleviate all or at least some of the drawbacks of the presently known systems.

In other embodiments, the disclosure provides a wireless communication system for a vehicle, such as a train. The wireless communication system may include a communication unit arranged inside the vehicle; an antenna provided on or above an exterior metal surface of the vehicle; a power cable connecting the antenna to the communication unit; a data transferring path connecting the antenna to the communication unit, for transfer of data there between; and a protective shield being formed of a conductive material and being electrically and mechanically bonded to the exterior metal surface of the vehicle. The shield may include a cavity for accommodating the antenna, and at least one waveguide aperture extending through the protective shield and into the cavity, thereby enabling radio frequency waves to pass through the protective shield into and out from the antenna.

The disclosure may be based on the notion that a protective shield may be used to provide both a mechanical and electrical protection. In particular for high frequencies, such as in the millimeter band, the wavelength is very small compared to the overall dimensions of the antenna, and other equipment, such as high voltage parts on or around the vehicle. Thus, the waveguide apertures may be made relatively small, which may increase the mechanical robustness and the electrical conductivity of the shield.

The disclosure, when used together with an active millimeter-wave antenna, may achieve safety equivalent to or even better than the requirements described above, and as defined in various standards, but without the need for costly and complex filtering and surge arresting arrangements, et cetera, as used previously for other types of active antenna and similar more demanding arrangements. Thus, a very versatile solution, suitable for most type of antennas, and in particular millimeter wave active antennas such as active phased array antennas and the like, may be provided in a very cost-effective, robust, and affordable way.

The disclosure may be further based on the notion that small waveguide apertures are effective to transfer radio frequency signals of high frequency, but they also efficiently prevent transfer of high power electric signals of lower frequencies.

The terms "waveguide aperture" as used in the context of the disclosure is to be interpreted broadly to mean a structure forming a waveguiding channel surrounded by reflective walls, in which electromagnetic waves may be guided along the length of the channel. The dimensions of the channel may be adapted to the frequency of interest, but larger dimensions may also be used.

The shield forms an outer antenna structure (e.g., shell or body) constructed from a conductive and mechanically strong material such as aluminum, which is dimensioned in all aspects to withstand the mechanical force and electrical current necessary to fulfill standards requirements and the strike of a falling high-voltage catenary, pantograph, et cetera.

Since the protective shield is electrically and mechanically connected and bonded to the exterior metallic surface of the vehicle (e.g., a train roof), it may be electrically grounded by electrically connecting to the metal frame and surface of the vehicle. The shield may be further mechanically fixated to the body of the vehicle, which may provide a strong mechanical protection.

The antenna may have an operating frequency exceeding 1 GHz, preferably exceeding 20 GHz, and more preferably exceeding 30 GHz. In an embodiment, the operating frequency of the antenna is within the extremely high frequency (EHF) range, extending between 30 and 300 GHz, corresponding to wavelengths in the range 1-10 mm.

The antenna may be an active antenna, and preferably an active millimeter-wave antenna. The antenna may be a phased array antenna for MIMO communication which may operate in compliance with 5G standards. The antenna may include an array of antenna elements. Each antenna element may be connected to a separate transceiver. The transceivers may be powered by the power cable.

The protective shield may include a plurality of waveguide aperture. One waveguide aperture may be provided for each antenna element. As a result, a very efficient transfer of radio frequency wave may be obtainable with low losses. Such configuration may provide a very robust and strong shield.

Optionally, larger waveguide apertures may be used where each one of the waveguide apertures may be arranged to transfer wave signals from more than one antenna elements. In one embodiment, a single waveguide aperture may be arranged to transfer wave signals from all the antenna elements.

The shield may be formed by a solid metal material (e.g., aluminum). According to one embodiment, the shield may have a minimum exterior wall thickness and a minimum waveguide aperture length both exceeding 1 cm, preferably exceeding 1.5 cm, and more preferably exceeding 2 cm.

The data transferring path connecting the antenna to the communication unit may be implemented in various ways, such as by a co-axial cable, an optical fiber, a waveguide, et cetera.

The shield may have a base area provided to be in contact with the exterior metal surface of the vehicle and a top area opposite to the base area. The base area may have a larger extension in at least a width or length direction than the top area. Side walls may extend between the base area and the top area. At least one of the side walls may be arranged in a slanted disposition. According to an embodiment, several (or all) side walls may be arranged in a slanted disposition. The slanted disposition and the enlarged base area provide a more robust and more securely fixated shield, which may increase the safety and mechanical security. In particular, the slanted side wall(s) may minimize the effects of physical impacts such as hits by falling cables and the like.

The angle of the slanted side wall(s) may be in the range of 10-80 degrees in relation to the exterior metal surface, preferably in the range of 20-70 degrees, and more preferably in the range of 30-60 degrees. The side wall facing the travelling direction of the vehicle may be more slanted than the other side walls, such as being in the range of 10-60 degrees, preferably in the range of 20-50 degrees, and more preferably in the range of 20-40 degrees. The side walls not facing in the travelling direction of the vehicle may be slightly less slanted, such as being in the range of 30-80 degrees, preferably in the range of 30-70 degrees, and more preferably in the range of 40-60 degrees.

Optionally, the active electronic circuitry of the antenna may be placed in a cavity inside the structure of the protective shield. The cavity may occupy less than 50% of the total volume of the protective shield, and preferably less than 45%, and more preferably less than 40%.

Each of the at least one waveguide aperture may have a rectangular or circular cross-section. Further, each of the at least one waveguide aperture may have a maximum cross-sectional dimension of less than 10 mm, and preferably less than 5 mm. At the present radio frequencies, the holes may be in a few millimeters along their largest cross-sectional dimension. For instance, an antenna for the 60 GHz millimeter-wave band could use a WR15-section waveguide, with a cross-section of 3.76×1.88 mm. Given the very small size of these holes, maintaining the mechanical and electrical protection offered by the antenna structure may be easily achieved. However, larger waveguide apertures may also be used and be arranged to transfer waveguide signals to and from several (or all) antenna elements.

In an embodiment, the radiating elements of the antenna may face the end(s) of one or several waveguides furnished as hole(s) of rectangular or circular cross section connecting the cavity with the outside of the antenna structure. Thus, a plurality of waveguides may be arranged side-by-side in a horizontal pattern, and may be further backed by a plurality of radiating elements within the cavity to allow synthetic beamforming in the horizontal plane by means of phase adjustment of the signals transmitted by each radiating element. In another embodiment, a plurality of waveguides may be arranged in a grid such that beamforming may be performed in both the horizontal and vertical planes.

The protective shield may include a plurality of waveguide apertures. All the waveguide apertures may extend in parallel with each other. In particular, a plurality of waveguide apertures may be provided in a plane being essentially parallel to the exterior metal surface to form a row of waveguide apertures. Alternatively, a plurality of waveguide apertures may be provided in two or more planes being essentially parallel to the exterior metal surface to form rows and columns of waveguide apertures. However, the antenna structure may also include a solid metal structure with a single waveguide and an internal cavity carved out of the metal. The waveguide may connect a radiating element in the internal cavity with free space outside of the antenna.

The protective shield may further include a protective cover arranged over the outlet ends of the waveguide apertures to prohibit dirt, water, or other forms of contaminations from entering the waveguide apertures. The protective cover may be made of a plastic material.

The communication unit may include at least one router in the vehicle. The router may be configured to receive and transmit wireless data packets to and from a stationary communication server outside the vehicle through at least one exterior mobile network via the antenna, and to and from at least one client onboard the public transport vehicle via at least one access point connected to the router.

The wireless communication system may operate in compliance with Wireless Local Area Network (WLAN) standards such as IEEE 802.11 standards, and/or via cellular network standard(s), such as 5G standards.

The base stations with which the antenna is to communicate may be trackside base stations arranged or distributed along the extension of the railway(s). In particular, the trackside base stations may be access points for communication in compliance with WLAN standards (e.g., IEEE 802.11 standards).

An internal LAN may be provided inside the vehicle, and in particular a public transportation vehicle, for providing wireless communication between the router and at least one client onboard. The at least one client onboard may accordingly be connected to a router within the vehicle via a LAN (local area network) provided by one or more wireless access points within the vehicle. Optionally, at least one such wireless access point may be provided in each carriage. All wireless access points may be connected to a single central router arranged in one of the carriages of a train. However, each carriage in the train may also be provided with a separate router connected to at least one wireless access point. The wireless access point may be external to the router or an integrated function of the router.

According to an embodiment, the external wireless network may include a plurality of trackside base stations such as trackside access points. The trackside access points may be distributed along a vehicle path of travel and located along the predetermined route. The coverage of each trackside base station may be inter alia dependent on the height of the antenna of the cell, the height of the vehicle, the maximum, minimum or average distance between the vehicle and the antenna, and the frequency of communication. Optionally, the trackside base stations may operate at carrier frequencies of about 5 GHz or of about 60 GHz.

The communication between the trackside base stations and the mobile router may be made in compliance with WLAN standards (e.g., IEEE 802.11 standards, known as Wi-Fi). However, it is also possible to use other wireless communication protocols.

The router may, in addition to the trackside WLAN (or other protocol used for the communication with the trackside base stations), use any available data links, such as one or more of GSM, Satellite, DVB-T, HSPA, EDGE, 1X RTT, EVDO, LTE, Wi-Fi, and WiMAX. Optionally, these communication data links may be implemented individually or in combination to form a virtual network connection. In particular, it may be desirable to use data links provided through wireless wide-area network (WWAN) communication technologies.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The disclosure claimed is:

1. A wireless communication system for a vehicle, comprising:

a communication unit arranged inside the vehicle;

an antenna provided on or above an exterior metal surface of the vehicle;

a power cable connecting the antenna to the communication unit;

a data transferring path connecting the antenna to the communication unit; and a protective shield made of a conductive material; wherein:

the protective shield is electrically and mechanically bonded to the exterior metal surface of the vehicle;

the protective shield comprises a cavity for accommodating the antenna;

an exterior wall of the protective shield has a thickness of larger than 1 cm;

a waveguide aperture extends through the protective shield and into the cavity;

the waveguide aperture has a thickness of larger than 1 cm; and the waveguide aperture enables radio frequency waves to pass through the protective shield into and out from the antenna.

2. The wireless communication system of claim 1, wherein the antenna operates at a frequency larger than 1 GHz.

3. The wireless communication system of claim 1, wherein the antenna is an active antenna.

4. The wireless communication system of claim 3, wherein the antenna comprises an array of antenna elements; and each antenna element is connected to a separate transceiver.

5. The wireless communication system of claim 4, wherein:

the protective shield comprises a plurality of waveguide apertures; and each antenna element is provided with a respective waveguide aperture.

6. The wireless communication system of claim 1, wherein the protective shield is made of a solid metal material.

7. The wireless communication system of claim 1, wherein:

the protective shield includes a base area, a top area, and side walls;

the base area is in contact with the exterior metal surface of the vehicle;

the top area is opposite to the base area;

the base area is larger than the top area;

the side walls extend between the base area and the top area; and at least one of the side walls is arranged in a slanted disposition.

8. A wireless communication system for a vehicle, comprising:

a communication unit arranged inside the vehicle;

an antenna provided on or above an exterior metal surface of the vehicle;

a power cable connecting the antenna to the communication unit;

a data transferring path connecting the antenna to the communication unit; and a protective shield made of a conductive material; wherein:

the protective shield is electrically and mechanically bonded to the exterior metal surface of the vehicle;

the protective shield comprises a cavity for accommodating the antenna;

a waveguide aperture extends through the protective shield and into the cavity;

the waveguide aperture enables radio frequency waves to pass through the protective shield into and out from the antenna;

the waveguide aperture has a rectangular or circular cross-section; and the waveguide aperture has a cross-sectional dimension of less than 10 mm.

9. A wireless communication system for a vehicle, comprising:

a communication unit arranged inside the vehicle;

an antenna provided on or above an exterior metal surface of the vehicle;

a power cable connecting the antenna to the communication unit;

a data transferring path connecting the antenna to the communication unit; and a protective shield made of a conductive material; wherein:

the protective shield is electrically and mechanically bonded to the exterior metal surface of the vehicle;

the protective shield comprises a cavity for accommodating the antenna;

the protective shield comprises a plurality of waveguide apertures;

the plurality of waveguide apertures extend in parallel with each other;

the plurality of waveguide apertures are provided in a plane in parallel with the exterior metal surface; and the plurality of waveguide apertures form a row of waveguide apertures.

10. A wireless communication system for a vehicle, comprising:

a communication unit arranged inside the vehicle;

an antenna provided on or above an exterior metal surface of the vehicle;

a power cable connecting the antenna to the communication unit;

a data transferring path connecting the antenna to the communication unit; and a protective shield made of a conductive material; wherein:

the protective shield is electrically and mechanically bonded to the exterior metal surface of the vehicle;

the protective shield comprises a cavity for accommodating the antenna;

the protective shield comprises a plurality of waveguide apertures;

the plurality of waveguide apertures extend in parallel with each other;

the plurality of waveguide apertures are provided in two or more planes in parallel with the exterior metal surface; and the plurality of waveguide apertures form rows and columns of waveguide apertures.

11. The wireless communication system of claim 1, wherein:

the communication unit comprises at least one router in the vehicle;

the router is configured to receive and transmit wireless data packets from and to a stationary communication server outside the vehicle through at least one exterior mobile network via the antenna; and the router is configured to receive and transmit wireless data packets from and to at least one client onboard the vehicle via at least one access point connected to the router.

12. The wireless communication system of claim 11, wherein the wireless communication operates in compliance with Wireless Local Area Network (WLAN) standards.

13. The wireless communication system of claim 11, wherein the wireless communication operates in compliance with cellular network standards.

* * * * *